US007766335B1

(12) United States Patent
Greenawalt

(10) Patent No.: US 7,766,335 B1
(45) Date of Patent: Aug. 3, 2010

(54) BOARD GAME WITH 3D DYNAMIC GAME PLAY

(76) Inventor: Thomas H. Greenawalt, 1917 Swan La., Palm Harbor, FL (US) 34683

( * ) Notice: Subject to any disclaimer, the term of this patent is extended or adjusted under 35 U.S.C. 154(b) by 122 days.

(21) Appl. No.: 11/306,682

(22) Filed: Jan. 6, 2006

(51) Int. Cl.
*A63F 3/00* (2006.01)

(52) U.S. Cl. ..... 273/241; 287/287

(58) Field of Classification Search ..... 273/241, 273/280, 282.1, 282.2, 282.3, 283, 284, 287, 273/281, 242
See application file for complete search history.

(56) References Cited

U.S. PATENT DOCUMENTS

| | | | | | |
|---|---|---|---|---|---|
| 1,656,943 | A | * | 1/1928 | Firestone | 273/254 |
| 3,458,198 | A | | 7/1969 | De Lucia et al. | |
| 3,514,111 | A | * | 5/1970 | Crawford | 273/238 |
| 3,588,113 | A | * | 6/1971 | Nelson | 273/271 |
| 3,594,002 | A | | 7/1971 | Glass et al. | |
| 3,649,021 | A | * | 3/1972 | Hayes | 273/243 |
| 3,656,757 | A | | 4/1972 | Carroll | |
| 3,658,337 | A | * | 4/1972 | Peters et al. | 273/254 |
| 3,735,986 | A | | 5/1973 | Glass et al. | |
| 3,754,763 | A | | 8/1973 | Breslow | |
| 3,860,242 | A | * | 1/1975 | Martin | 273/243 |
| 3,884,475 | A | * | 5/1975 | Munro et al. | 273/256 |
| 3,985,361 | A | | 10/1976 | Millen | |
| 4,142,725 | A | | 3/1979 | Gilbert et al. | |
| 4,147,359 | A | * | 4/1979 | King | 273/241 |
| 4,182,514 | A | | 1/1980 | Magid et al. | |
| 4,225,138 | A | * | 9/1980 | Wolf | 273/243 |
| 4,326,711 | A | * | 4/1982 | Giallombardo | 273/431 |
| 4,333,655 | A | * | 6/1982 | Rudell et al. | 273/241 |
| 4,569,527 | A | | 2/1986 | Rosenwinkel et al. | |
| 4,575,094 | A | | 3/1986 | Ferris et al. | |
| 4,949,975 | A | | 8/1990 | Carrier | |
| 5,004,246 | A | | 4/1991 | Merrill et al. | |
| 5,314,188 | A | | 5/1994 | Mason et al. | |
| 5,478,086 | A | | 12/1995 | Aylett | |
| 5,887,871 | A | | 3/1999 | Zappolo | |
| 5,924,693 | A | | 7/1999 | Beaumier et al. | |
| 6,203,017 | B1 | | 3/2001 | Schultz | |
| 6,247,696 | B1 | * | 6/2001 | Lackender | 273/280 |
| 6,419,228 | B1 | * | 7/2002 | Egli et al. | 273/236 |
| 6,481,714 | B1 | | 11/2002 | Jacobs | |
| 2004/0130095 | A1 | | 7/2004 | Miller | |

FOREIGN PATENT DOCUMENTS

| | | |
|---|---|---|
| GB | 2 391 490 A1 | 2/2004 |

* cited by examiner

*Primary Examiner*—Vishu K. Mendiratta
(74) *Attorney, Agent, or Firm*—Robert Varkonyi; Thomas E. Toner; Smith & Hopen, P.A.

(57) ABSTRACT

A board game incorporating multiple paths of travel which traverse a plurality of elevations with moveable obstacles that change the paths of travel. The moveable obstacles take the form of moveable structures; such as stairs; bridges and moveable-walls which cut-off some available paths while opening others. Through strategic use of the obstacles; players can facilitate their own movement through the game while impeding that of their opponents.

10 Claims, 5 Drawing Sheets

BOARD GAME WITH 3D DYNAMIC GAME PLAY

BACKGROUND OF THE INVENTION

The present invention relates to a board game and more specifically a game with a game board having multiple elevations and changing paths of travel contained thereon.

Many well-known board games incorporate a game board having a start and exit point with a path of travel, sometimes multiple paths, therebetween. Usually, the path of travel is divided into increments, or segments, wherein movement along the path is determined by the number of segments. For example, a player rolling a six (6) on a dice can move six segments.

It is also known in the art to incorporate game boards that have multiple levels associated with the path of travel. For example, U.S. Pat. No. 6,481,714 to Jacobs describes a game board having three levels with at least one stairway connecting each level. The game board is fashioned to resemble a medieval castle. U.S. Pat. No. 4,569,527 to Rosenwinkel et al. describes a board game in which players construct a mansion during the course of play. The resulting game board has multiple levels connected by stairs.

Some game boards have also incorporated moving elements to affect game play, as in altering the path the players must take to win. U.S. Pat. No. 3,606,334 to Pippin describes a flat game board with rotating discs associated with the paths of travel contained thereon. As the discs rotate, the paths of travel are altered.

However, the prior art lacks a board game incorporating the elements of multiple levels associated with changing paths of travel thus rendering each game different from the last.

SUMMARY OF INVENTION

The long-standing but heretofore unfulfilled need for a three-dimensional game board having dynamic paths of travel and which also includes other improvements that overcome the limitations of the prior art is now met by a new, useful, and non-obvious invention.

In a general embodiment, the novel board game includes a playing surface having a plurality of elevations. At least one start location and at least one exit location is delineated on the playing surface. At least one segmented path of travel is delineated on the playing surface between the start and end locations. There can be a common start location, located at the center of the board for example, and a common exit location; alternatively each player can begin the game in a unique start location and move toward a common or player-specific exit location (usually located on a periphery of the board). At least one moveable obstacle is associated with at least one path of travel. Each player begins with at least one marker, player-piece. A player-action generator, or generators, dictate how many segments each player can move on any given turn. The player-action generator also controls when a player is allowed to move an obstacle, either to that player's benefit or an opposing player's detriment.

The moveable obstacles serve to alter at least one path of travel. In various embodiments the moveable obstacle is at least one moveable obstacle-structure disposed upon the playing surface, with at least one periphery of the obstacle-structure disposed adjacent a portion of a path of travel delineated on the playing surface. Examples of these obstacles include, but are not limited to, bridges, stairs and moveable walls. In some embodiments the obstacle-structure, stairs for example, connects at least one path of travel on a first elevation of the playing surface with at least one path of travel on a second elevation of the playing surface. Alternatively, the obstacle-structure, a bridge for example, connects at least one path of travel on a first elevation of the playing surface with at least one path of travel on the same elevation of the playing surface. The obstacle-structure, such as a moveable wall, can also interrupt at least one path travel while possibly opening a new path of travel.

In another embodiment, the moveable obstacle is at least one moveable obstacle-surface having a plurality of distinguishable cells delineated thereon. The obstacle-surface is associated with the playing surface such that at least one cell coincides with a segment of a path of travel. The cells delineated on the obstacle-surface indicate the status of the coinciding segment of the path of travel, "blocked" for example. The obstacle-surface can either be mounted anywhere on the playing surface or disposed beneath the playing surface. In embodiments where the obstacle-surface is disposed beneath the playing surface; at least one segment of a path of travel is adapted to reveal at least one cell delineated on an obstacle-surface disposed beneath the playing surface. Such adaptations can include an empty space on the playing surface above the coinciding cell, or a clear segment which functions as a window.

Movement through the path of travel can be controlled by any means known in the art. In one embodiment, player-movement cards are coupled with player-action cards. Player movement cards are generally related to the number of segments a player can advance. Movement can be expressly stated, as in "move 6 spaces," or can be tied to a random number generator such as dice, i.e. "roll a six-sided die and move that number of spaces."

Player-action cards instruct players on activities not directly tied to movement. For example one player-action may be "select two obstacles and their positions." This would allow a player to either advance his own movement or hinder the movement of an opponent. The first player to move his marker, or all of his markers, to an exit is declared the winner.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Referring now specifically to the drawings, the board game of the present invention is generally designated by numeral 10 and is constructed of lightweight materials forming an elevated surface based on a substantially rigid panel. The panel is substantially rectangular in shape but the shape, size and configuration may vary without deviating from the present invention. For example, the game board can be square, oval, circular, polygonal or of any size and shape. Moreover, it is conceivable that the game board be constructed of a pliable sheet material.

Figure 1:
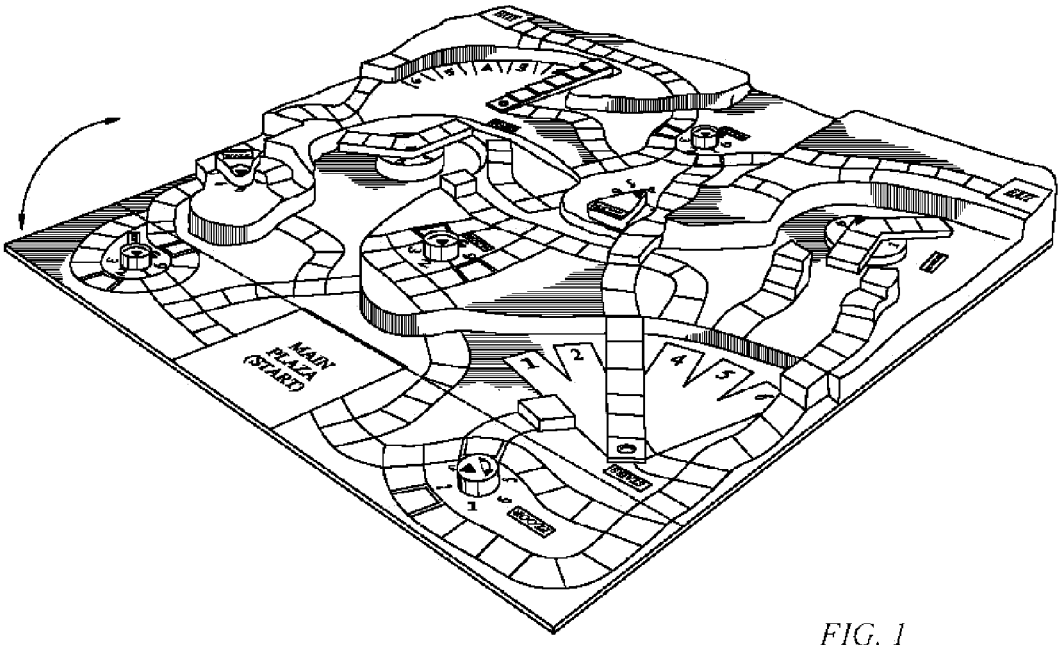
FIG. 1 is a plan view of the game board illustrating potential locations for start and end locations as well as potential locations of moveable obstacles.

FIG. 1 shows an illustrative embodiment of the current invention. Game board 10 has multiple elevations over which multiple paths of travel 30 are delineated. Paths of travel 30 extend from start location 20 and traverse the surface of game board 30. Paths of travel 30 terminate in either an exit location 25 or a dead end 25*a*. Dead ends 25*a* can be circumvented, as described below, thus allowing path of travel 30 to terminate in an exit location 25.

Figure 2:
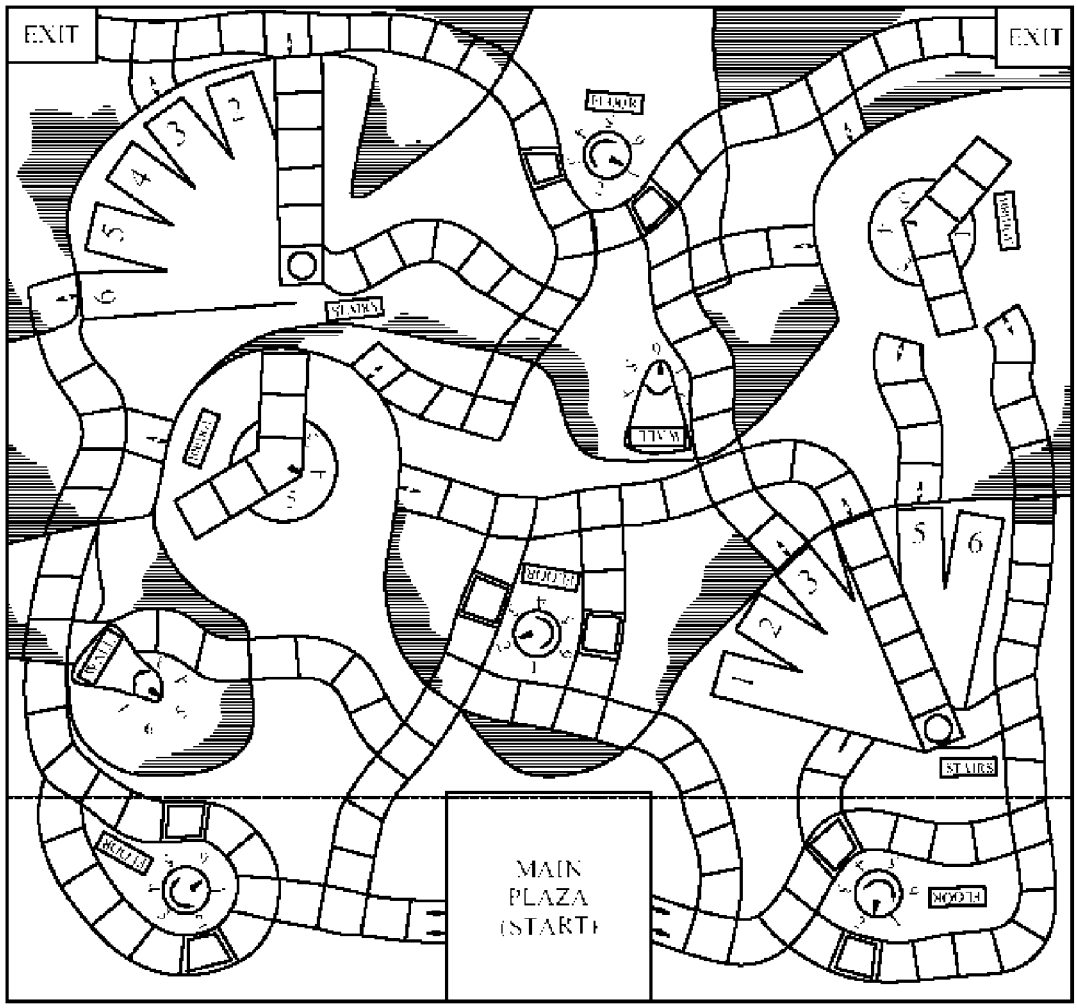
FIG. 2 is a perspective view of a possible gameboard.

Positioned on game board 10, as shown in FIG. 2, are a plurality of moveable obstacles. The moveable obstacles can take many forms but in one embodiment include obstacle-structures 40*a* and obstacle-surfaces 40*b*. Moveable obstacles 40*a* and 40*b* serve to alternately interrupt or make available a path of travel. Strategic use of the obstacles allows a player to accomplish both objectives simultaneously.

Obstacle-Structures

Figure 3A:
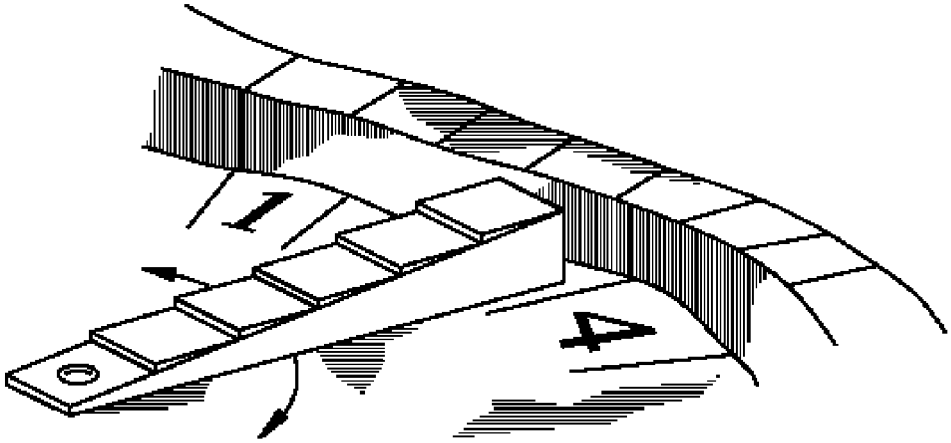
FIG. 3A is a close-up view of an obstacle-structure in the form of stairs.
Figure 3B:
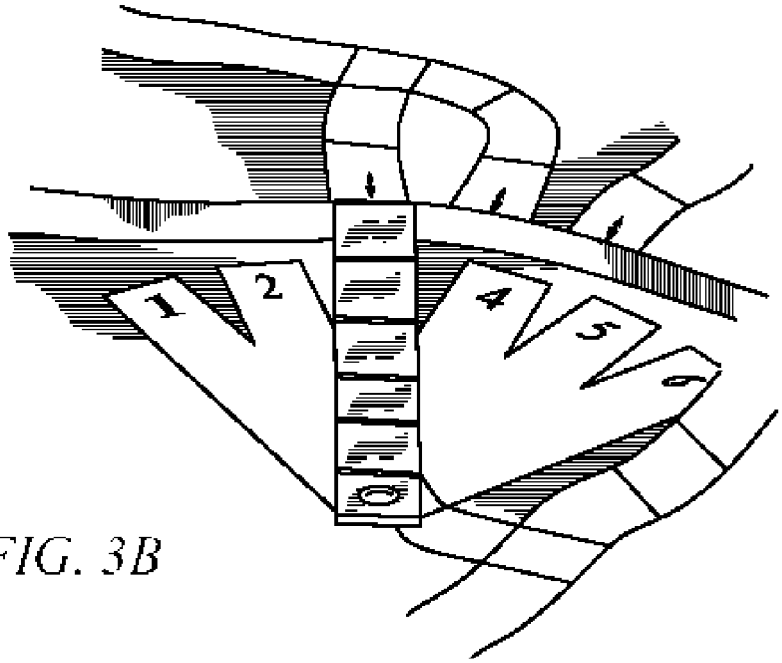
FIG. 3B is a close-up view of an alternate obstacle-structure in the form of stairs.

Referring now to FIGS. 3A and 3B; in various embodiments moveable obstacle 40 is at least one moveable obstacle-structure 40*a* disposed upon playing surface 10, with at least one periphery of the obstacle-structure 41 disposed adjacent a portion of a path of travel 30. Examples of these obstacles include, but are not limited to, bridges, stairs and moveable walls. As shown in FIG. 3A, obstacle-structure 40*a* is disposed in the form of stairs rotatably mounted to game board 10 having an axis of rotation 42 located at one end. Arrow indicator A illustrates the path of travel of the upper periphery 41 of stairs 40*a* (FIG. 3A). In the example shown in FIG. 3B, stairs 40*a* connect upper path of travel 30*a* with a lower path of travel 30*b* when lower periphery 42 is in locations 3, 4 or 5 as indicated on game board 10. Stairs 40*a* end in a dead-end when upper periphery 41 rests in locations 1, 2 or 6. Arrow indicators 31*b* are used to show which segments of a path of travel form a continuous path when adjacent to moveable obstacles 40*a* (FIG. 3B).

Figure 4:
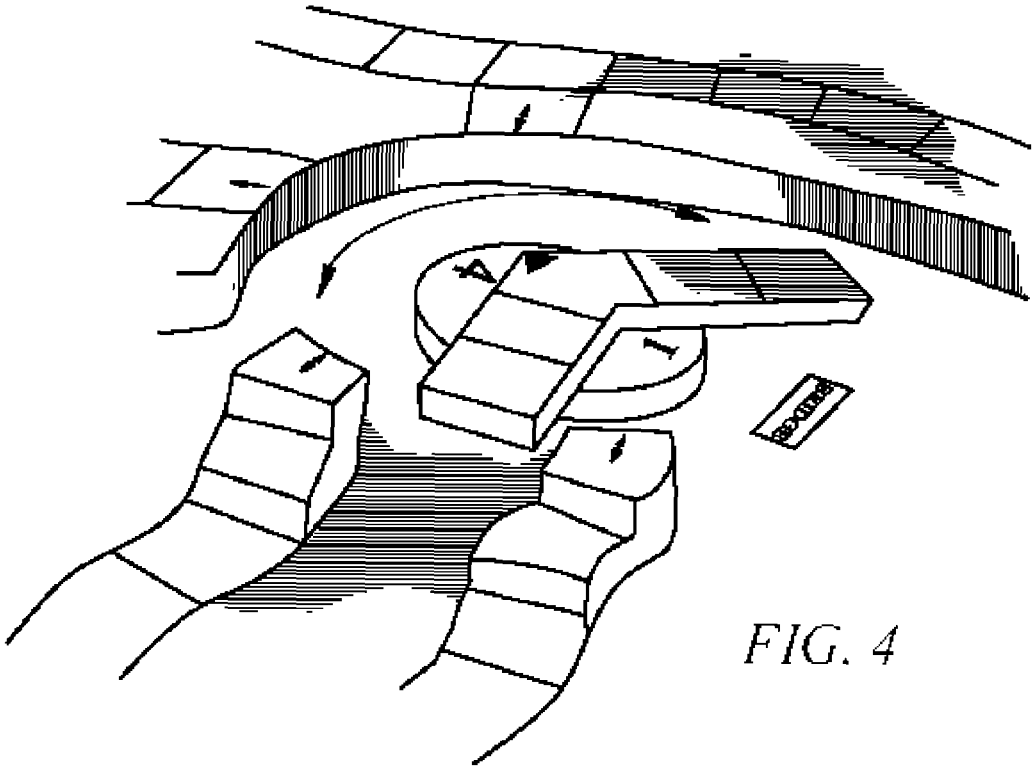
FIG. 4 is a close-up view of an obstacle-structure in the form of a bridge.

Obstacle-structure 40*a* can also take the form of rotating bridges, as shown in FIG. 4. Although point of rotation 42*a* can vary, it generally resides in the center of bridge 40*a*. Bridges 40*a* are generally used to connect one path of travel 30 to another path of travel on the same level. Arrow indicators 31*b* show that when bridge 40*a* is in position 4, path of travel 30 is interrupted. If bridge 40*a* is placed in position 5, not shown, path of travel 30 is completed. If bridge 40*a* is placed in position 5, the two ends terminate in a dead-end and the bridge would inaccessible. The position of inaccessibility of a bridge provides illustration of potential game strategy. If an opposing players marker resides on a bridge, it may be possible for a player to move the bridge to a position of inaccessibility, position 5 for example. The opposing player would thereby be trapped and unable to move until he is able to move the bridge.

Figure 5:
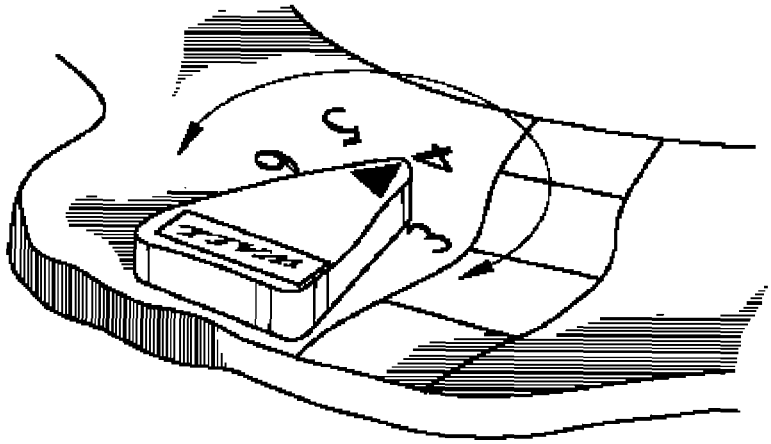
FIG. 5 is a close-up view of an obstacle-structure in the form of a moveable-wall structure.

A third type of possible obstacle-structure, moveable-wall structure 40*a*, is shown in FIG. 5. In this example, moveable-wall structure 40*a* comprises a moveable element on the surface of game board 10. Given the path-of-travel of moveable-wall structure 40*a* is usually circular its most common center of rotation 42 is its center; although this not required. At least one portion of moveable-wall structure 40*a* comprises an elevated surface 45 thereby forming a wall which blocks a path of travel. In FIG. 5, the entire length of moveable-wall structure 40*a* comprises elevated surface 45 which interrupts normal path of travel 30 in positions 5, 6 and 1. It should be noted that moveable-wall structure 40*a*$^3$ could comprise an additional cell having an elevated surface. For example, if the moveable-wall structure shown in FIG. 4 had an additional elevated surface on cell 4, normal path of travel 30 would terminate in a dead-end. Moreover, a player resting on cells 1, 6 or 5 could become trapped if the moveable-wall structure were moved to location 1. In other embodiments, the moveable element is a disc with a peripheral path of travel delineated its face by radial division lines to form at least one cell. The cells are substantially equal in size a shape to a single segment of a path of travel. A moveable-wall structure thereby interrupts a first path of travel but allows a player to continue along peripheral path of travel.

Although the previous obstacle-structures comprise a preferred embodiment of the present invention; many other moveable obstacles could be incorporated. Generally speaking; stairs relate to any obstacle-structures which complete a path of travel between at least two points on different elevations of the game board; bridges relate to any obstacle-structures which complete a path of travel between at least two points on the same elevation of the game board; and moveable-wall structures relate to obstacle-structures which interrupt a continual path of travel, even if such interruption creates a new path of travel. It also contemplated that movement of the obstacle-structures be linear (slidable), rather than pivotable.

Obstacle-Surfaces

Figure 6:
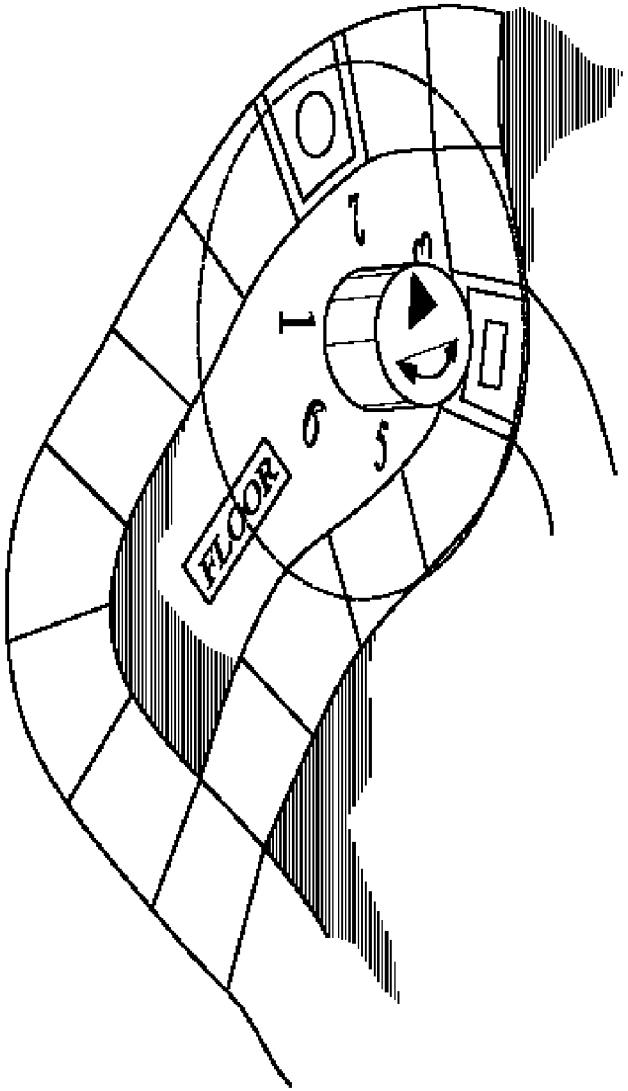
FIG. 6 is a close-up view of an obstacle-surface in the form of a moveable-floor tile or pathway.

Alternatively, obstacles can take the form of obstacle-surfaces 40*b* as shown in FIG. 6. In one embodiment, obstacle-surfaces 40*b*, comprise cells (not shown) which can be delineated by radial division lines. Radial division lines are not essential so long as each cell is visibly distinguishable. Obstacle-surfaces 40*b* can take many forms and can either be rotatably associated with the surface of game board 10, as with moveable-wall structures 40*a*, or can disposed there beneath. The cells are capable of coinciding with at least one segment of a path of travel 41*b* adapted to reveal the image contained within the cell.

In the embodiment shown in FIG. 6, wherein obstacle-surface 40*b* is disposed within game board 10, coincident segments 41*b* are altered to allow viewing of the cells beneath. Coincident segments 41*b* can be formed by many methods including removing the surface of game board 10 within the coincident segment thereby allowing direct viewing of the cell. Alternatively, coincident segment 41*b* can be constructed from a transparent material to form a window allowing visibility of the cell.

The image contained on each cell determines the status of the coincident segment. For example, a cell may be blank, indicating normal travel, or contain a picture of fire, a pit, rubble or other obstruction, a snake or other creature indicating the segment is impassable, or the image of some barrier directing movement along one path while cutting off movement along another (where the coincident segment lies at the intersection of more than one path). FIG. 6 shows an example where obstacle-surface 40*b* is disposed within game board 10, and contains cells coincident with two segments 41*b* of different paths of travel. In this example, coincident segment 41*b* may reveals a cell which shows "fire," indicating segment 41*b* is impassable. The position of obstacle-surface 40*b* is particularly nefarious in this example given its proximity to an exit location. A player located on the path of travel opposite exit location is forced to either backtrack or wait until someone moves obstacle-surface 40*b* allowing movement over coincident segment 41*b*.

Example—Game Play

An example of rules accompanying the novel board game are included below. The following rules of game play are provided to place the novel board game in context only. Multiple themes, rules and objectives can be incorporated.

Theme: Eccentric billionaire, I. M. Specter, has offered a $10 million prize to the first team to escape from the haunted ruins recently discovered on the Specter estate in Central America. Can you and your team be the first to escape the Haunted Ruins?

Object: Be the first player to move all of your pawns through the ruins.

Contents: (1) Game Board, (4) sets of 4 pawns in red, green, blue and yellow (1) 6-sided die, (1) 12-sided die, (52) Haunted Ruins playing cards, and (4) playing card breakdown sheets.

Setup: a) Shuffle the playing cards and deal 2 cards, face-down to each player. The remainder of the deck is kept face-down for further drawings.

b) The player with the highest die roll starts the game and a pawn color. The selection of pawn color continues clockwise from the starting player.

c) The players agree on the number of pawns to be played based on the following average playing times. 2 players: 3 pawns each in 20-30 minutes or 4 pawns each in 30-40 minutes. 3 players: 3 pawns each in 30-40 minutes or 4 pawns each in 40-50 minutes. 4 players: 2 pawns each in 30-40 minutes or 3 pawns each in 45-55 minutes.

d) Each player places their pawns on the Start space.

e) Roll the 6-sided die to determine the starting position of all 10 obstacles. The obstacle positions are located next to and/or on the obstacle. Set each obstacle to the position number rolled. The obstacles are: (4) floors, (2) bridges, (2) stairways and (2) walls.

l) The player with the highest die roll starts the game with playing continuing clockwise.

Play: 1) The starting player draws the top card from the deck and adds it to the two cards dealt during the setup. The player must play one of those 3 cards and follow the instructions on the played card. The played card is discarded for future replenishment of the deck. Players take one turn at a time with play moving clockwise. During a turn, a player may have to choose between playing "move" cards or "action" cards. "Move" cards require rolling a die and moving the pawns the amount of spaces as rolled. Players can move pawns in any direction including backtracking and back-and-forth. "Action" cards require the changing of obstacles, swapping pawns, or overcoming obstacles. Refer to the Haunted Ruins Cards breakdown sheet to review the breakdown of the 52 cards.

2) When playing a Move card, the player is able to distribute the spaces among multiple pawns. For example, if a 9 is rolled, the player could move one pawn 5 spaces, the second pawn for 3 spaces and the third pawn for 1 space. NOTE: A pawn cannot land on an occupied space. Pawns can be moved in any direction but all of the rolled number must be used. Yellow spaces, in the floors and at the walls, are pass-through only and cannot be occupied between turns.

3) When playing an Action card, the player must follow the instructions on the card and move 6 spaces before, during or after the action. Again, all of the 6 spaces must be used with pawns moved in any direction. NOTE: There will be times when the action is not applicable (i.e. no fire to be extinguished) but the card is still played in order to move 6 spaces. NOTE: When playing a "Select 2 Obstacles & Their Positions" card, a player can not move the same obstacle twice during that turn.

4) Continue playing until a player has moved their pawns to either of the two exits. Note: If the Haunted Ruins cards are exhausted before a player wins, shuffle the discard deck and resume.

Breakdown of Haunted Ruins Cards

30 Move cards: 15 Moves with 6-sided die and 15 Moves with 12-sided die.

22 Action cards: 2 Swap Positions with another Player; 6 Select 2 Obstacles and Positions; 2 Kill Snake with Sword; 2 Extinguish Fire with Water; 1 Roll Die for Position of All Floors; 1 Select Position for All Floors; 1 Roll Die for Position of Both Bridges; 1 Select Position for Both Bridges; 1 Roll Die for Position of Both Stairs; 1 Select Position for Both Stairs; 1 Roll Die for Position of Both Walls; 1 Select Position for Both Walls; 1 Select Position for One Bridge and One Stair; and 1 Select Position for One Floor and One Wall.

Playing Tips: a) Use "Swap Positions" cards very carefully. Try to use these cards when you can move your pawn quickly to an Exit space; b) Try to move pawns equally away from the Start. Don't leave a pawn isolated close to an Exit and thus expose it to a "Swap Positions" card; c) Try to use all of your pawn moves during a turn. Move another pawn if one pawn is blocked by an obstacle. Each move of a pawn is important!; d) Don't panic if you are moving toward an obstacle that is blocking progress because the Ruins are truly haunted and obstacles are constantly changing. The "Select 2 Obstacles & their Positions" cards are very valuable in optimizing your path to exits; e) Continually review the 2 Haunted Ruin cards in your hand and try to develop a strategy to use action cards based on the position of your opponents and the position of the various obstacles; f) Move your pawns along with your opponents' pawns. You may get lucky and be able to take advantage of favorable obstacle positions that they created; g) Haunted Ruins is a game of offense and defense. When given the opportunity to select obstacles don't forget to play some defense by setting up "blocks" on your opponents. The best turns are characterized by one action that helps you and another that hurts an opponent; h) Pay attention to the type of cards played and discarded. For example: if a "Swap Positions" card has been played then you know there is only one left before the deck is reshuffled. This knowledge is invaluable in developing your strategy and anticipating your opponents' strategy; i) To play a slightly faster game; allow the same obstacle to be moved twice in a turn when playing a "Select 2 Obstacles and their Positions" card.

It will be seen that the objects set forth above; and those made apparent from the foregoing description; are efficiently attained and since certain changes may be made in the above construction without departing from the scope of the invention; it is intended that all matters contained in the foregoing description or shown in the accompanying drawings shall be interpreted as illustrative and not in a limiting sense.

It is also to be understood that the following claims are intended to cover all of the generic and specific features of the invention herein described; and all statements of the scope of the invention which; as a matter of language; might be said to fall there between. Now that the invention has been described;

What is claimed is:

1. A board game comprising:

a game board with a game board face, having at least one start location disposed on the game board face;

a plurality of elevated surfaces disposed on the face of the game board;

a plurality of segmented paths disposed on the game board face and plurality of elevated surfaces, where the segmented paths begin at the at least one start location;

at least one moveable obstacle disposed on the game board; wherein the at least one obstacle is selected from the group consisting of a pivoting wall structure, further comprising a horizontal member having a first end and a second end, where the first end is pivotally connected to the game board or one of the elevated surfaces, where the horizontal member rotates between at least a first position and a second position;

a three-dimensional vertical member disposed on the second end of the horizontal member, such that the vertical member is disposed on one of the segmented paths of travel when the horizontal member is disposed in the second position;

a sliding wall structure, further comprising a horizontal member having a first end and a second end, where the first end and second end are slideably connected to the game board or one of the elevated surfaces, where the horizontal member slides between at least a first position and a second position;

a three-dimensional vertical member disposed between the first end and the second end of the horizontal member, such that the vertical member is disposed on one of the segmented paths of travel when the horizontal member is disposed in the second position;

a pivoting bridge, further comprising an elevated pivot surface having the size of about one segment of the segmented path;

a segmented horizontal member having a first end and a second end, where the segmented horizontal member is pivotally connected to the elevated pivot surface at the medial section of the segmented horizontal member and rotates between at least a first position and a second position;

where the first end is disposed adjacent to a first segmented path and the second end is disposed adjacent to a second segmented path when disposed in the first position;

a sliding bridge, further comprising a segmented horizontal member having a first end and a second end, where the first end slideably engages a first elevated surface of the game and the second end slideably engages a second elevated surface of the game, where the segmented horizontal member slides between at least a first position and a second position;

where the first end is disposed adjacent to a first segmented path and the second end is disposed adjacent to a second segmented path when disposed in the first position;

a pivoting segmented staircase, further comprising a first end at a first elevation and a second end at a higher, second elevation, where the first end is disposed adjacent to a first segmented path and wherein the first end is pivotally connected to the game board or one of the elevated surfaces and rotates between at least a first position and a second position;

where the second end is disposed adjacent to a second segmented path when the staircase is disposed in the second position;

a sliding segmented staircase, further comprising a first end at a first elevation and a second end at a higher, second elevated surface, where the first end is disposed adjacent to a first segmented path and wherein the first end is slideably connected to the game board and the second end is slideably connected to the second elevated surface and slides between at least a first position and a second position;

where the second end is disposed adjacent to a second segmented path when the staircase is disposed in the second position; and a floor, further comprising a horizontal disc member segmented into a plurality of elements, where the disc member is rotatably connected to the game board or one of the elevated surfaces, where the plurality of elements are disposed on at least one segmented path;

a knob disposed on the pivot of the disc member.

2. The board game of claim 1 wherein the moveable structure is between at least one path of travel on a first elevation of the playing surface and at least one path of travel on a second elevation of the playing surface when the moveable structure is in the first position.

3. The board game of claim 1 wherein the moveable structure is between at least one path of travel on a first elevation of the playing surface and at least one path of travel on the same elevation of the playing surface when the moveable structure is in the first position.

4. The board game of claim 1 wherein the moveable structure is at least one-segment of a path of travel.

5. The board game of claim 4 wherein the at least one segment of a path of travel has an indicia therein indicating that there should be no movement of a marker thereon.

6. The board game of claim 4 wherein the moveable structure is affixed to the playing surface in a position selected from the group consisting of a position above the playing surface and a position below the playing surface.

7. The board game of claim 1 wherein the moveable structure is not between any two segments when it is in the first position.

8. The board game of claim 1 wherein the playing surface further comprises a first position indicator and a second position indicator associated with at least one moveable structure.

9. The board game of claim 8 wherein at least one moveable structure has a movement indicator disposed thereon; and wherein the movement indicator is aligned with the first position indicator when the moveable structure is in the first position; and wherein the movement indicator is aligned with the second position indicator when the moveable structure is in the second position.

10. The board game of claim 1, wherein the game board is comprised of a substantially rigid panel.

* * * * *